US007955225B1

(12) United States Patent
James

(10) Patent No.: US 7,955,225 B1
(45) Date of Patent: Jun. 7, 2011

(54) AUTOMATICALLY VARIABLE STRIDE WALK-RUN-STEPPER PEDAL EXERCISER

(76) Inventor: William Edward James, Greenville, SC (US)

( * ) Notice: Subject to any disclaimer, the term of this patent is extended or adjusted under 35 U.S.C. 154(b) by 0 days.

(21) Appl. No.: 09/674,996

(22) PCT Filed: Jul. 27, 1999

(86) PCT No.: PCT/US99/16991

§ 371 (c)(1),
(2), (4) Date: Nov. 2, 2000

(87) PCT Pub. No.: WO00/06256

PCT Pub. Date: Feb. 10, 2000

(51) Int. Cl.
*A63B 22/00* (2006.01)

(52) U.S. Cl. ..... 482/51; 482/70

(58) Field of Classification Search ..... 482/51–54, 482/70, 71, 74, 121, 122, 123, 148, 907
See application file for complete search history.

(56) References Cited

U.S. PATENT DOCUMENTS 4,681,316 A * 7/1987 DeCloux ..... 482/113
4,861,023 A * 8/1989 Wedman ..... 482/51
5,183,449 A * 2/1993 DeCloux ..... 482/53
5,188,577 A * 2/1993 Young et al. ..... 482/53
5,267,923 A * 12/1993 Piaget et al. ..... 482/53
5,314,390 A * 5/1994 Westing et al. ..... 482/6
5,342,264 A * 8/1994 Gordon ..... 482/70
5,368,532 A 11/1994 Farnet
5,437,587 A * 8/1995 Prince et al. ..... 482/7
5,626,539 A 5/1997 Piaget et al.
5,741,205 A 4/1998 Doll et al.
5,792,029 A * 8/1998 Gordon ..... 482/52
5,910,072 A * 6/1999 Rawls et al. ..... 482/51
5,947,872 A 9/1999 Ryan et al.
5,989,163 A * 11/1999 Rodgers, Jr. ..... 482/70
6,019,710 A * 2/2000 Dalebout et al. ..... 482/70
6,123,650 A * 9/2000 Birrell ..... 482/70
6,135,926 A * 10/2000 Lee ..... 482/57
6,258,012 B1 * 7/2001 Yoshimura ..... 482/52
6,302,830 B1 * 10/2001 Stearns ..... 482/70
6,361,476 B1 * 3/2002 Eschenbach ..... 482/52
6,612,969 B2 * 9/2003 Eschenbach ..... 482/51
7,025,710 B2 * 4/2006 Corbalis et al. ..... 482/52

* cited by examiner

*Primary Examiner* — Loan Thanh
*Assistant Examiner* — Tam Nguyen

(57) ABSTRACT

This pedal exerciser allows normal walking and running in place on pedals (16, 17) reciprocal back and forth by returning the pedal from varying strides to a forward step-down position in response to user's end of stride action of stepping down on the forward pedal and lifting the other foot at the rear. A return force is applied to a pedal only during its return stroke, avoiding the high force opposing user's stride of elastic return devices. This enables high return forces to return the pedals at high stride rates and long strides without high user stride effort, making possible pedal exercisers allowing normal, varying walk-run strides as on powered treadmills but without a motor drive. Mechanical and pneumatic versions are described, manual and motorized, providing cushioned step-down with automatic stride length, speed variation and stopping responding to user's foot force.

18 Claims, 6 Drawing Sheets

AUTOMATICALLY VARIABLE STRIDE WALK-RUN-STEPPER PEDAL EXERCISER

BACKGROUND OF THE INVENTION

This invention pertains to the field of exercise equipment, broadly to stationary walk, run, stepper, striding, and pedaling machines such as treadmills, cross-country skiers, steppers, and various pedal cycles and, more specifically, to walk-run pedal or foot pad type exercisers.

It has long been recognized that exercise involving the legs is best for accomplishing aerobic exercise necessary for total conditioning and cardiovascular health. But, in recent years it has also been found that the step-down impact produced in walking, jogging and running, including treadmill use, can cause debilitating damage to foot, ankle, knee and hip joints.

Some treadmills have been introduced to address this problem by adding cushioning means under the belt or the belt support deck. But, belt cushioning increases drag and belt wear and deck cushioning is relatively limited, since the movable mass is still substantial and the vertical deflection capability is small. Some treadmills provide cushioning on top of or under the belt, but this is very costly and/or belt durability is reduced. Also, treadmills, with the momentum of the moving belt, pulleys, and drive train, can be dangerous to less adept and older users since the belt continues to move if the user trips and falls or needs to stop quickly for any reason. Also, due mainly to belt drag, power consumption is high, making it difficult to design a practical user-powered treadmill or a durable, yet low cost powered one.

Steppers and climbers generally produce more vertical foot motion than horizontal, simulating stepping up-down or climbing stairs, most having some incidental horizontal motion component due to pivotal action of the pedals on levers or an inclined guide track. These typically allow variable stroke steps and stopping within a single step, but the predominant motion is up and down and they are harder on ankle, knee and hip joints due to high joint articulation angles compared to normal, primarily horizontal walk-run strides. Also, these machines do not involve as much the large hamstring leg muscles as do the long, predominantly fore and aft strides of walking and running, and are not conducive to good cardiovascular workouts with minimum strain.

Pedal cycles, though involving the hamstring muscles more than steppers and climbers and allowing relatively quick, safe stops, especially the sitdown types, still require high hip and knee joint articulation and strain. They do avoid the impact inherent in treadmills, somewhat offsetting the high articulation strain. However, a largely unspoken disadvantage of pedal cycles, a result of pedal stroke being controlled by a rotating crank, is the constant stroke. This prevents any change in stroke or stride as can and does occur without any lost motion in normal walking, jogging and running. Thus, pedal cycles are constraining and become laborious or tedious sooner than treadmills and are more likely to be underused or worse, unused, a major problem in exercise equipment.

A recent variation of the pedal cycle elongates the pedals horizontal stroke while reducing vertical displacement so the resulting elliptical foot motion is closer to that of walking or running and at low impact. But, the laborious-tedious factor due to the constant, crank-controlled stroke is still present. Also, the fixed stroke as supplied may not be suitable for many people, since there is a wide range of sizes, strides, ages and abilities to satisfy.

Another exerciser, the cross-country skier, involves the hamstring muscles and minimizes impact and joint articulation, the feet moving attached skis backward against a resistance and being free to return at any length of stride. But, the attached skis' mass and length, and a need to pull the ski forward with the foot at the end of each stroke results in, again, a more constrained and laborious feel compared to normal walk-run action.

Various simpler exercisers, typically called striders, involve pedals or foot pads that move back and forth, staying in a single plane or arc. Another provides vertical motion independently of its back and forth motion, but balances the user's weight between the two pedals. These all allow variable length strokes or strides, but none provides the easy, normal walk-jog-run action of stepping down on, and transferring essentially all the weight to the forward foot, and freely swinging the unweighted trailing foot forward while pushing back on the weighted foot, then stepping down to end the stride at any point in each stride, from one stride to the next. These "strider" devices allow only balancing the user's weight more or less continuously between the two pedals while the feet are pushed backward and forward in equal strokes in opposite directions from the user's center of gravity. Again, this results in a constrained and laborious feel, unlike normal walk-run action in which each leg is unweighted on each forward return stroke.

Of the entire field of stand-up leg working exercisers, only the treadmill provides a realistic, normal walk-run experience as described, and its continuing popularity in the face of many and varied pedal and foot pad type machines being introduced, indicates that this normal walk-run action is an important desired characteristic. The primary detracting characteristics, high impact, inability to stop quickly, and high belt drag and power requirement are difficult to improve upon within the context of the continuous belt treadmill design at reasonable cost. An additional drawback of the typical motor driven belt treadmill is that any change in stride length must be accompanied by an instant related change in strides per unit time unless the belt speed is adjusted. On user powered, flywheel speed regulation treadmills, one can change stride, although not quickly, without a corresponding rate change, since foot force and motion powers the belt. But, the high belt drag and the attendant high angle of incline typically required for the user's weight to be employed to move the belt is a big negative.

Among the wide variety of pedal or foot pad machines, only the elliptical motion cycle seems to provide a reasonable approximation of the normal walk-run action, but stroke or stride is not automatically variable, though some may be adjustable. Of all the pedal or foot pad type machines allowing variable strokes or strides, none provides realistic, normal walk-run stride action including forward foot step down with essentially full weight transfer to that foot (involving placement of the user's center of gravity essentially directly above it), and a largely unweighted opposite, returning foot, free of any parts of the machine with automatically varying stride lengths from stride to stride.

Comparing walking in-place on a machine with walking on the ground or floor, it should be noted, there are some subtle differences. In ground walking, at forward foot step-down, marking the end of a stride, the body center of gravity is initially positioned slightly behind the step-down point, the body moving forward and rocking forward over the step-down point as the weighted foot starts to push rearward in the next stride. In-place walking, with no forward body momentum, involves stepping down essentially always at the same point directly under the center of gravity unless the user is holding on to handrails or the like and pushing the belt rearward or resisting its motion. Longer in-place strides, then, involve pushing back farther from a more or less fixed step-down point, and strides are shortened by simply stepping down sooner with the returning foot. It can be seen that machines having pedals or foot pads simply connected for equal and opposite back and forth motion can not be used for varying length realistic walking or running strides. If a user starts with both pedals abreast and pushes back with the weighted foot, the opposite pedal moves forward an equal distance, far ahead of his center of gravity. Then, if the user shifts his body position to be over the far forward position at step-down after a long stride, and makes only a short stride on the next push back, the opposite returning pedal will come back only a short distance from the previous long stride, far short of the user's center of gravity. Any change of stride will result in a change in return distance of the returning pedal, not to the required constant step-down position. Thus, machines directly connecting the pedals for equal and opposite back and forth motion do not provide realistic, normal walk-run action with variable length strides. They allow only moving the feet back and forth about the body's center of gravity, always essentially equally weighted or, in some cases, allow only fixed stride lengths with normal walk-run action. Striders having no pedal return means require the user to keep his feet always essentially equally weighted and no step action as in normal walking is possible.

Therefore, existing foot pad or pedal exercisers do not provide realistic, normal variable stride length walk-run action as on a treadmill, and treadmills do not provide the low impact at step-down or quick stop capability of some foot pad or pedal machines. Also, the typical motorized treadmill does not allow freely varying stride length without immediate compensating varying of stride rate or manually adjusting the belt speed. Additionally, no existing exerciser allows stride for stride changing between walking, jogging, running, and stepping action.

BRIEF SUMMARY OF THE INVENTION

It is a broad object of this invention to provide a walk-run reciprocating pedal exercise machine that allows realistic, natural variable stride length foot lifting/step-down walk-run action as on a treadmill, but with the additional freedom to change stride length independently of stride rate and vice versa, or as in normal walking or running on the ground.

A supporting object is to provide a walk-run reciprocating pedal exercise machine in which the return of each pedal forward to the step-down position from varying stride lengths is initiated and caused by the user's front foot step-down and accompanying rear foot unweighting action, these two essentially concurrent actions always marking each end of stride. Thus, the user's end of stride action of front foot step-down and rear, returning foot lifting at varying stride lengths will cause the rear pedal to quickly return to its forward step-down position in time for the next (returning foot) step-down, the pedals essentially following the user's varying strides and even anticipating each next stride, the rear pedal starting to move forward to be positioned for the next step-down immediately upon step-down on the opposite, front pedal or lifting of the rear foot at the rear pedal.

Another object is to provide a walk-run exercise machine as described wherein the step-down force and energy on the forward pedal at each end of stride is utilized directly or indirectly to return the opposite, rear pedal to its forward step-down point.

Also, it is an object to provide a walk-run exercise machine as described wherein lift-off of the rear foot from the rear pedal at the end of stride initiates and causes return of the rear pedal to the step-down position.

It is also an object to provide a walk-run reciprocating foot pad or pedal exercise machine as described which provides significant reduction of step-down impact forces compared to typical treadmills by cushion means on or under the pedals.

Also, it is an object to provide a low cost user powered walk-run exercise machine as described wherein friction drag is significantly lower than in sliding belt treadmills.

Another object is to provide a low cost powered walk-run exerciser as described which requires less power than sliding belt treadmills.

It is another object to provide a walk-run exerciser as described wherein the user's varying foot force rearward or forward controls starting and stopping and increasing or decreasing speed in both user powered and motorized versions.

Other objects and advantages of the invention will become evident in the following continued summary and description.

The basic principle of this invention rests on the observation that natural or normal walking or running involves easy, almost unconscious stride length changes from stride to stride, and that the step-down of the forward foot marks the end of each stride. At step-down there is always a transfer of all the weight from the rear, pushing foot to the forward foot and the rear foot immediately lifts and starts to swing forward in the next stride. Running or jogging as opposed to walking, by definition, involves rear foot lift-off slightly before step-down of the front, the runner propelling himself forward and upward into an air-borne state near the end of each stride. In in-place walking or running the forward moving or returning foot always steps down at essentially a fixed location and strides are lengthened by pushing back farther and longer on the rearwardly pushing foot after step-down.

The invention, employing these facts, provides a number of versions of a variable stroke or stride foot pad or pedal exerciser for walking, jogging and running with pedals movable primarily forward and backward, wherein the step-down of the user's forward foot on its corresponding pedal and/or the lifting of the rear, pushing foot from its pedal initiates and causes or actuates the forward return stroke of the rear pedal, causing it to return to the forward step-down position in time for the next step-down. In other words, the invention is a foot pad or pedal machine for true walking, jogging or running in-place at varying length strides and speeds wherein the foot pads or pedals automatically keep pace with the user's foot steps from stride to stride.

LIST OF PARTS REFERENCE NUMBERS

Figure 1:
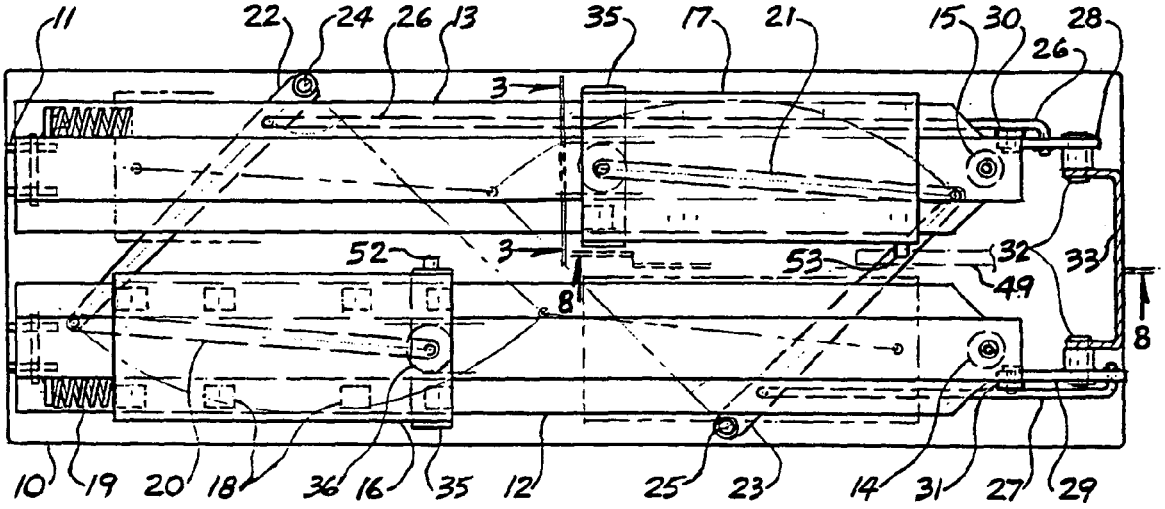
FIG. 1 is a plan view of a mechanical user powered version of the invention.

| No. | Name |
|---|---|
| 10 | Base |
| 11 | Track Bar Pivot Tabs |
| 12 | Right Track Bar |
| 13 | Left Track Bar |
| 14 | Right Spring Damper |
| 15 | Left Spring Damper |
| 16 | Right Pedal |
| 17 | Left Pedal |
| 18 | Pedal Wheels |
| 19 | Stop Springs |
| 20 | Right Pedal Control Link |
| 21 | Left Pedal Control Link |
| 22 | Right Pedal Lever |
| 23 | Left Pedal Lever |
| 24 | Right Lever Pivot Pin |
| 25 | Left Lever Pivot Pin |
| 26 | Left Side Pull Link |
| 27 | Right Side Pull Link |
| 28 | Left Side Bellcrank |
| 29 | Right Side Bellcrank |
| 30 | Left Side Push Link |
| 31 | Right Side Push Link |
| 32 | Bellcrank Pivot Pins |
| 33 | Front Pylon |
| 34 | Ball Joint Bearings |
| 35 | Pedal Underside Crossbar |
| 36 | Pedal Guide Wheels |
| 37 | (Not used) |
| 38 | Right Track Bar Cylinder |
| 39 | Left Track Bar Cylinder |
| 40 | Right Support Spring |
| 41 | Left Support Spring |
| 42 | Right Return Cylinder |
| 43 | Left Return Cylinder |
| 44 | Right to Left Tubing |
| 45 | Left to Right Tubing |
| 46 | Right Limit Valve |
| 47 | Left Limit Valve |
| 48 | Air Input Tubing |
| 49 | Pedal Latch |

-continued

LIST OF PARTS REFERENCE NUMBERS

| No. | Name |
|---|---|
| 50 | Latch Pivot Pin |
| 51 | Latch Spring |
| 52 | Right Pedal Lug |
| 53 | Left Pedal Lug |
| 54-59 | (Not used) |
| 60 | Pedal Rollers |
| 61 | Right Roller Spacer |
| 62 | Left Roller Spacer |
| 63 | Right Spring Lug |
| 64 | Left Spring Lug |
| 65 | Right Return Lug |
| 66 | Left Return Lug |
| 67 | Right Return Spring |
| 68 | Left Return Spring |
| 69 | Motor |
| 70 | Gearbox |
| 71 | Right Drive Drum |
| 72 | Left Drive Drum |
| 73 | Right Drive Wheel |
| 74 | Left Drive Wheel |
| 75 | Drive Wheel Spring |
| 76 | Sprag Clutch |
| 77 | Right Stop Bar |
| 78 | Left Stop Bar |
| 79 | (Not used) |
| 80 | Floating Drive Base |
| 81 | Flexures |
| 82 | Flexure Supports |
| 83 | Position Sensor |
| 84 | Speed Control |
| 85 | (Not used) |
| 86 | Right Guide |
| 87 | Left Guide |
| 88 | Support Wheels |
| 89 | Shaft |
| 90 | Support Bearings |
| 91 | Right Drive Wheel |
| 92 | Left Drive Wheel |
| 93 | Drive Pulley |
| 94 | Drive Belt |
| 95 | Drive Pulley |
| 96 | Flywheel/Resistor |
| 97 | Support Spindle |
| 98 | Right Band Spring |
| 99 | Left Band Spring |
| 100 | Right Spring Housing |
| 101 | Left Spring Housing |
| 102 | Right Pedal Cushion |
| 103 | Left Pedal Cushion |
| 104 | Track Bar |
| 105 | Upper Link |
| 106 | Lower Link |
| 107 | Surface Plate |
| 108 | Foot Plate |
| 109 | Jack Valve |
| 110 | Right Pedal Guide |
| 111 | Left Pedal Guide |
| 112 | Right Track |
| 113 | Left Track |
| 114 | Support Springs |
| 115 | Track Pivot Pads |
| 116 | Right Air Bag |
| 117 | Left Air Bag |
| 118 | Right Return Bellows |
| 119 | Left Return Bellows |
| 120 | Air Tank |
| 121 | Right One-Way Valve |
| 122 | Left One-Way Valve |
| 123 | Right Pilot Valve |
| 124 | Left Pilot Valve |
| 125 | Right Flow Control |
| 126 | Left Flow Control |
| 127 | Right Return Tube |
| 128 | Left Return Tube |
| 129 | Pilot Tube |
| 130 | Flexible Tubing |

-continued

LIST OF PARTS REFERENCE NUMBERS

| No. | Name |
|---|---|
| 131 | Right Stop Bellows |
| 132 | Left Stop Bellows |
| 133 | Right Stop Valve |
| 134 | Left Stop Valve |
| 135 | Arm Lever |
| 136 | Arm Lever Bellows |
| 137 | Arm Bellows Valve |
| 138 | Air Bag Jack |
| 139 | Relief Valve |
| 140 | Pump |
| 141 | Pump Inlet Tube |
| 142 | Pressure Sensor |

DETAILED DESCRIPTION OF THE INVENTION

This invention is broadly a stationary exercise machine for walking, jogging and running in place having two foot pads or pedals (hereinafter referred to as pedals) which are supported for reciprocal motion primarily horizontally forward and backward, one pedal under each of the user's feet, and having pedal forward return means for returning the rear pedal to the in-place step-down position in response to the user's end of stride action of lifting his foot off the rear pedal and stepping down on the opposite pedal at variable stride lengths. The user can walk, jog, or run in a normal foot-lifting, step-down fashion at varying stride lengths and speeds from stride to stride and the pedals will move in time with his feet, each pedal returning to the forward step-down position in time for each step-down. The pedals preferably include cushion means on, within or under the pedal to reduce step-down impact force, and in some cases the step-down force and energy is transferred to propel the pedals forward during their return strokes.

Several versions of the invention are described herein, some user powered and others by motor or by compressed air. Some versions employ the step-down force on either pedal to directly actuate the opposite pedal's return, while others provide energy storage means to use this energy and pedal return momentum stopping force energy, recuperating some of the pedal's forward travel energy, and other sources to provide pedal return force in an indirect manner. The simplest uses spring force, the spring acting forwardly on the pedal so that it is compressed during the backward push by the user and propels the pedal forward to the step-down position when the foot lifts off. One version uses an outside source of compressed air which could be a relatively small, low pressure motorized pump, the air flow being switched by a slight downward motion of the forward pedal to return the opposite pedal.

Automatic speed variation and starting and stopping of the pedals in response to the user's foot force rearward or forward on the pedal is a valuable feature made practicable by this invention and means for providing these are described herein for both user powered and motorized versions.

Figure 2:
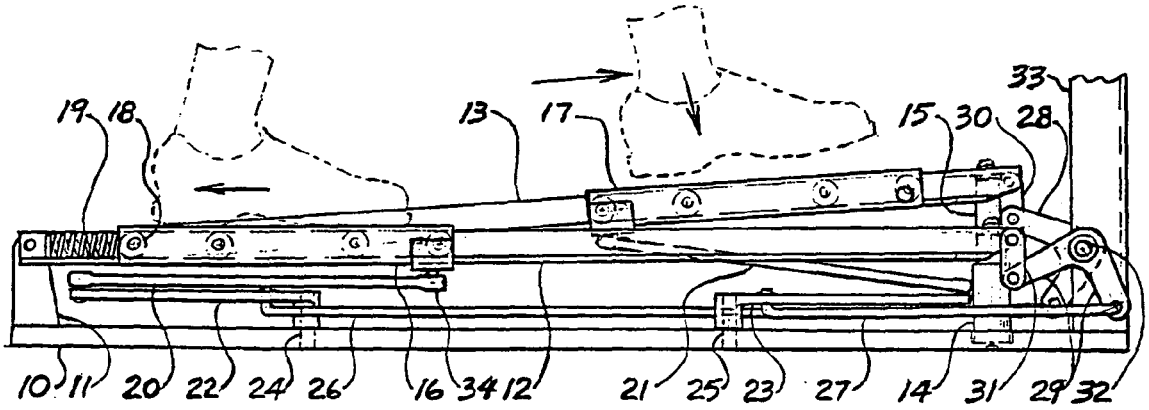
FIG. 2 is a side elevation view of the FIG. 1 machine.

FIGS. 1 and 2 are plan and side elevation views respectively, depicting a mechanical user powered version of the invention wherein downward force on and resulting downward deflection of either pedal causes the opposite pedal to move forward to the step-down position. Conversely, the push back stroke of either pedal raises the opposite pedal back up. In these views, a Base 10, shown as a flat plate for clarity and having a length somewhat greater than a typical stride length, holds two pairs of Track Bar Pivot Tabs 11 standing up from the Base 10 at the rear of the machine (at left in the views). A Right Track Bar 12 and a Left Track Bar 13 are supported pivotally at their rearmost ends on the Pivot Tabs and are aligned longitudinally extending the length of the Base 10, parallel side by side in the plan view and movable vertically at their front ends as seen in FIG. 2. The front ends of the Track Bars 12 and 13 are supported on telescoping Spring Dampers 14 and 15 respectively, each including integral upwardly acting spring means so that a downward force on either Track Bar 12 or 13 will cause it to descend and releasing the force will cause it to rise.

A Right Pedal 16 and a Left Pedal 17, each equipped with Wheels 18, are mounted on the Track Bars 12 and 13 respectively to easily move longitudinally, Right Pedal 16 movable back and forth on Right Track Bar 12 and Left Pedal 17 similarly on Left Track Bar 13. Thus, the Pedals 16 and 17 are movable in relatively long paths back and forth and at the same time in relatively short up and down strokes as the their respective Track Bars 12 and 13 rise and descend. The relatively small vertical stroke when a pedal is at the rear of its track bar is partly a result of design for simplicity and of the recognition of a need for vertical displacement primarily at the front of the pedal's longitudinal stroke, the step-down position, as will be further explained. The length of back and forth pedal stroke can be designed for any maximum user stride desired. Since some users will always push the limits, Stop Springs 19 are positioned at the rear end of each pedal's longitudinal stroke to engage the pedal and stop its rearward motion directly to prevent overloading the rest of the moving mechanism controlling each pedal as next described. The pedals and all the moving mechanism would be ideally designed to be as light as possible, as impact at foot step-down increases in proportion to the mass that is accelerated.

Figure 3:
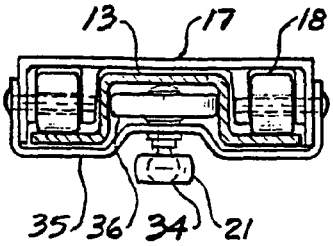
FIG. 3 is a partial sectional view from FIG. 1 showing 10 an end elevation view of a pedal and related parts.

The rest of the mechanism is primarily the interconnecting linkage that ties each Track Bar's front end vertical motion and, therefore, each Pedal's vertical motion to the opposite Pedal's back and forth motion. Since this involves a crossover of oppositely moving parts from side to side in the machine, it is not easy to arrive at a simple, compact design with low moving mass. The design shown in FIGS. 1-3 is intended to do this and provide a low overall machine profile, yet place most of the mechanism below the pedals and away from the user. Thus, Right Pedal 16 is connected to the front end of the Left Track Bar 13 through the following linkage train: Right Pedal 16 to: a Right Pedal Control Link 20 to: a Right Pedal Lever 22 to: a Left Side Pull Link 26 to: a Left Side Bellcrank 28 to: a Left Side Push Link 30 to: Left Track Bar 13. These are all pivotally interconnected as indicated, as is typical for links and levers. Likewise, the Left Pedal 17 is connected to: a Left Pedal Control Link 21 to: a Left Pedal Lever 23 to: a Right Side Pull Link 27 to: a Right Side Bellcrank 29 to: a Right Side Push Link 31 to: Right Track Bar 12. This design, one of many possible link and lever, cable and pulley designs and the like, provides the long pedal back and forth travel desired with a relatively short vertical stroke of the opposite pedal. Since the Pedal Levers 22 and 23 swing in essentially horizontal planes, pivoting on vertical Pivot Pins 24 and 25 respectively, and the pedals have some vertical movement, the Pedal Control Links 20 and 21 must have end pivot bearings with out-of-plane articulation freedom, thus these Links 20 and 21 have Ball Joints 34 at their ends as shown in FIGS. 2 and 3. Completing the details of the mechanical version, the Bellcranks 28 and 29 are mounted pivotally on two Bellcrank Pivot Pins 32 which are mounted on either side of a Front Pylori 33 which is a vertically extending part of the Base 10 and, as typical in walk-run exercisers, would extend high enough to support user handrails and the like. This version being powered by the user, the rearward pushing of the feet while walking or running in place will require the user's position to be held from moving forward by a hip-level bumper or the like or by inclining the Track Bars 12 and 13 or the entire machine upward at the front as is typical in user powered and powered walk-run exercisers. An additional advantage of the rear pivoting Track Bars 12 and 13 in this regard is that the initial incline of the Track Bar at step-down when the user is just starting the rearward stroke will provide an initial/rearward component of the user's weight on the Pedal. Linkage adjustment means, obviously, can be provided to adjust the initial and general inclination of the Track Bars, eliminating need for adjusting inclination of the Base 10.

FIG. 3 shows an elevation end view of the Left Pedal 17 and its Track Bar 13 with related parts and further details as follows: a Pedal Underside Crossbar 35 (one per pedal) through which the Pedal Control Link 21 is attached to the pedal under the Track Bar 13, the Right Pedal 16 being connected identically but at its opposite end to Right Pedal Control Link 20. A Pedal Guide Wheel 36 is mounted on the Pedal Underside Crossbar of each Pedal on the same axis as the corresponding Pedal Control Link connection to each pedal to roll along either side of the inside "hat section" of the Track Bar to oppose side forces.

In use, the user would step onto one of the Pedals, right foot on Right Pedal 16, for example, then left foot on Left Pedal 17, preferably holding handrails or the like. By the time the second or left foot is stepping on Left Pedal 17, that Pedal will have moved forward in response to the weight on Right Pedal 16. Before the user steps on the machine the Pedals would be ideally positioned in a mid-stroke or neutral location both longitudinally and vertically, both Pedals side-by-side at about mid-stroke.

The Spring Dampers 14 and 15 would be designed so that the upward spring force of each is in balance with the empty weight of its respective Pedal-Track Bar assembly when in this neutral position. Then, when the user steps on Right Pedal 16 and pushes back with that foot as in FIG. 2, that Pedal moves downward and back as shown. It has almost reached end of stride to the rear in FIG. 2. The interconnecting linkage between the Right Pedal 16 and Left Track Bar 13 has lifted the Left Pedal 17 above the neutral level as shown, while the Right Pedal 16 has descended below its neutral level soon after the step-down and caused the Left Pedal 17 to move to its forward position. When the right foot reaches its end of stride, coincident with the user stepping down at any point in the stride with the left foot on Left Pedal 17 as is about to occur in FIG. 2, the cycle is complete and then reverses. Next, as the user steps down on the Left Pedal 17, this Pedal and its Track Bar 13 start moving down, pulling the Right Pedal 16 forward during the descent of Left Pedal 17 as the user pushes back with the left foot on Left Pedal 17 which, in turn, raises the Right Track Bar 12 and its Pedal 16 back up to be ready for the next step-down of the right foot.

A significant and valuable feature of the invention as demonstrated in this mechanical version is the stepping down on the forward pedal at each end of stride causing the return of the opposite pedal forward to be quickly in position for the next, opposite foot step-down regardless of length of stride. This allows the user to change his stride from one step to the next and, in this user powered version, to change stride without any compensation in speed or rate of strides. The returning pedal will be back to the forward step-down position by the end of the down stroke of the opposite pedal being stepped on, not depending on any rearward stride of the opposite pedal. Thus, any stride can vary from essentially zero to the design maximum stroke of the machine from stride to stride without any action on the part of the user except simply changing his stride, stepping down sooner in each stride for shorter strides and later for longer strides.

The Pedals 16 and 17 would preferably be oversized in length and width compared to an average foot and have enough space between them to allow the foot to step somewhat past the inside edge of either pedal without touching the opposite pedal so the user would not have to be preoccupied with step placement. The user would simply walk, jog or run in place with a normal stepping motion, stepping down at more or less the same forward spot on each step, and pushing back at varying stride lengths and speeds, being able to stop at any point in any stride or step. The top surfaces of the Track Bars 12 and 13 are located close to the corresponding top surfaces of Pedals 16 and 17 so that when a user wants to stop quickly, he may simply step down somewhat short of the normal step-down point such that part of the foot, the heel in this case, will rest on the top of the track bar, braking the pedal. Alternatively, he may step down farther ahead so that the foot projects beyond the front of the pedal onto the track bar.

The downward deflection of each pedal at each step-down, supported by the Spring'Dampers 14 and 15 is large enough to provide significant cushioning of each step. This, combined with the fact that only a single pedal and its corresponding moving parts are deflected, allows reducing step-down impact forces compared to the typical treadmill. Also, replaceable cushion material can be attached to the pedal top surfaces at much lower cost than similar cushioning can be applied to a large belt. The Spring Dampers 14 and 15 in this version do double duty, since the interconnecting linkage between each pedal and its opposite track bar causes each rearward push on a pedal to be resisted by the upward elongation of the opposite spring damper. This provides a steadying or speed regulating resistance at the pedal. Damping characteristics of the dampers can be designed as required, possibly with different damping action on up strokes and downstrokes.

Ideally, the dampers would have variable, adjustable damping resistance. Variable spring stiffness such as with air springs and adjustable pressure could be provided to adjust for different user weights or preferences. With fixed spring rates in the Spring Dampers 14 and 15 in this version as shown, different user weights will result in different vertical displacement of the Pedals 16 and 17 and a corresponding variance in pedal return distance, although for a given user the pedals will always return to the same forward position at step-down. Also, the down stroke of the Track Bars 12 and 13 could be limited with overload or bottoming springs to prevent large variations.

Figure 8:
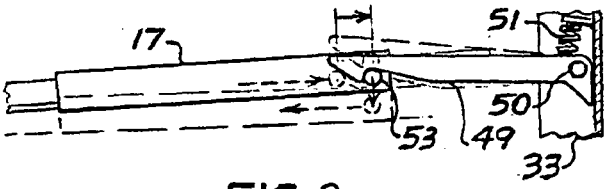
FIG. 8 is a partial sectional elevation view from FIG. 1 showing an optional pedal latch mechanism.

FIG. 8 is a sectional elevation view from FIG. 1 showing an optional pedal latching mechanism to hold each pedal in its forward step-down position until the user steps on the pedal. Without the Latch 49, due to the user's foot moving closer to the rear pivot axis of the corresponding track bar during each stride, the spring damper will tend to push the track bar and pedal back up and the opposite pedal will back away from the stepdown position. A Pedal Latch 49 can be added as shown pivotally mounted on the Front Pylon 33 on a Pivot Pin 50 and spring-loaded downward by a Latch Spring 51 and positioned between the Pedals 16 and 17 at the forward end of pedal travel. Pedals 16 and 17 will have corresponding Lugs, a Right Pedal Lug 52 as in FIG. 1 and a Left Pedal Lug 53 fixed to each at the front inside surface of the pedal to interact with Latch 49 as shown in FIGS. 1 and 8. The Pedal Latch 49 is wide enough to intersect either of the Pedal Lugs 52 and 53 and has an inclined nose end or free end with a notch immediately after on the bottom side, the notch sized and shaped to easily fit over either of the Pedal Lugs 52 and 53. A tail under the pivot end of the Latch 49 prevents the nose end from dropping below a certain level as shown in FIG. 8. When a pedal (Left Pedal 17 shown in FIG. 8) returns to the forward step-down position and rises as shown in FIG. 8 the Pedal Lug 53 will move into the notch of the Latch 49, the Spring 51 allowing Latch 49 to rise as the Lug 53 slides under the inclined nose of the latch, then forcing the latch down into engagement. When the user steps down on the pedal, the Latch 49, being limited as described in downward movement, will disengage the Pedal Lug 53, allowing the Pedal 17 to move rearward on the next stride.

Figure 21:
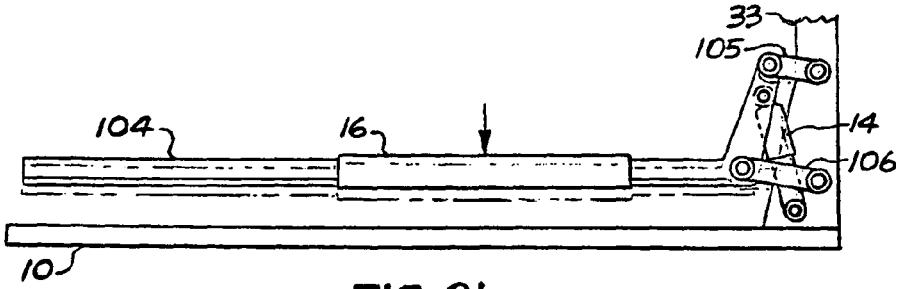
FIG. 21 is side elevation view of an alternate parallel link suspension of the track bars and pedals.

Another method for preventing or at least minimizing the pedal spring-back described above would be to design the Spring Dampers 14 and 15 to have a "detent" action upon reversing from down to up motion such as through a pop-off flow valve in the damper to prevent upward motion until a certain minimum upward force is exerted on the damper. This required upward force would be provided by the rearward force on the opposite pedal at the start of the next stride. Also, other means of supporting the pedals may be employed which do not exhibit the spring-back problem. In FIG. 21, a parallel link supported Track Bar 104 is shown supporting the Pedal 16 in the same way as the earlier described version. Two parallel links, an Upper Link 105 and Lower Link 106, spaced apart vertically and pivotally mounted on the front Pylon 33 of the machine and movable in vertical planes as shown, are pivotally connected at upper and lower journals of a front upward extension of the Track Bar 104, constraining the track bar to move vertically without any rotation. A Spring Damper 14 supports the Track Bar 104 and the Pedal 16 as shown so that pedal and track bar descend in unison when stepped on and rise when released as in the rear pivot version except there is no slight rotational motion and no change in leverage of the user's weight as the pedal moves rearward and no resulting spring-back. The rest of the mechanism, the pedal return linkage, would be essentially the same as in FIGS. 1-3.

Figure 4:
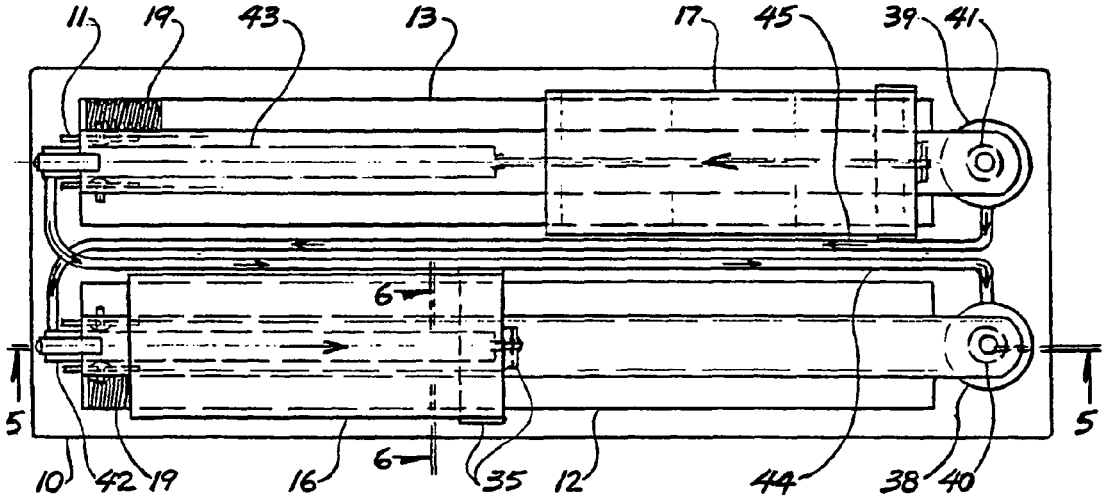
FIG. 4 is a plan view of a pneumatic user powered version.
Figure 5:
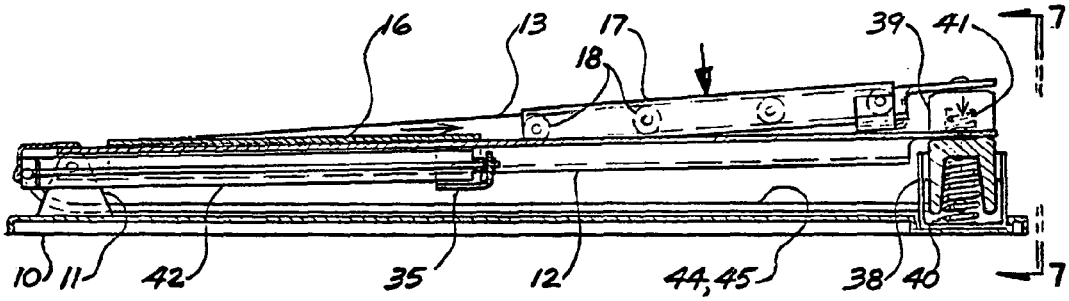
FIG. 5 is a side sectional elevation view of the FIG. 4 machine.

FIGS. 4 and 5 are plan and sectional side elevation views of a pneumatic version of the invention, the up and down motion of each pedal and track bar being connected to back and forth motion of the opposite pedal by air cylinders and connecting tubing. The main parts are essentially the same as in the mechanical version described above from the Base 10 through the Stop Springs 19, but not the Spring Dampers 14 and 15, although dampers may be used, and these operate as in the mechanical version. New parts in this pneumatic version replace the mechanical interconnecting linkage and the spring dampers with air cylinders and connecting tubing, the cylinders acting in master-slave fashion. Equivalents of cylinders such as "air bags", bellows, diaphragm actuators or the like may also be used.

A Right Track Bar Cylinder 38 containing a Right Support Spring 40 supports a Right Track Bar 12 and a corresponding Right Pedal 16 and provides pressurized air through a Right to Left Tubing 44 to a Left Return Cylinder 43 which pushes Left Pedal 17 forward as Right Pedal 16 is pushed downward. Likewise, a Left Track Bar Cylinder 39 with a Left Support Spring 41 supports a Left Track Bar 13 and Left Pedal 17 and provides pressurized air through a Left to Right Tubing 45 to a Right Return Cylinder 42 which pushes Right Pedal 16 forward as Left Pedal 17 is pushed downward.

This pneumatic version would operate in essentially the same way as the above mechanical version, and the neutral position before a user steps on the pedals would be accomplished through height and rate selection for the Support Springs 40 and 41. Air compressibility would add a spring effect between the down force on one pedal and the return force and motion of the opposite pedal, resulting in further cushioning effect on the step-down and a slight delay in the initial acceleration of the returning pedal. A similar spring effect could be added in a mechanical version for similar cushioning improvement by adding a spring in each of the connecting linkage trains. Another advantage of having spring compliance between pedal down stroke and opposite pedal return motion is that it allows arranging the ratio of down stroke to return travel so that the returning pedal will reach the forward step-down point at some relatively low step-down force, beyond which the spring (air in the pneumatic system) flexes to allow further down stroke due to a heavier user. This eliminates the returning pedal backing away from the step-down position, obviating need for the Pedal Latch 49 described earlier. Forward pedal return stops similar to the Stop Springs 19 shown at the rear end of stride position in FIG. 4 would be required. The ratio of the long pedal back and forth stroke to the short track bar up and down stroke is achieved in this pneumatic version by a larger diameter of the Track Bar Cylinders 38 and 39 relative to smaller bore, long stroke Return Cylinders 42 and 43. The Support Springs 40 and 41 return their respective track bars and pedals back up to their neutral unloaded positions.

Figure 6:
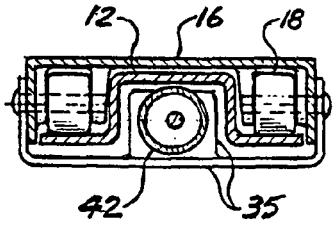
FIG. 6 is a sectional view from FIG. 5 showing an end elevation view of a pedal and related parts.

FIG. 6 is a sectional end elevation view from FIG. 4 of the Right Pedal 16 and its Track Bar 12 showing the Right Return Cylinder 42 under the Track Bar and connection of the Cylinder 42 to the Pedal 16 through a Pedal Underside Crossbar 35 (typical both sides).

Figure 7:
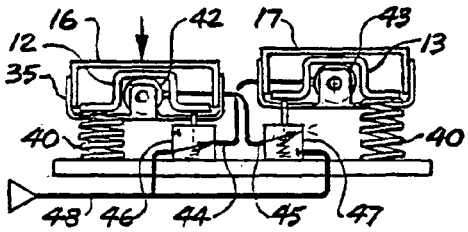
FIG. 7 is a front elevation view of an externally powered pneumatic version of the machine.

FIG. 7 is a front elevation view of a pneumatic version of the invention which, instead of the Track Bar Cylinders 38 and 39, utilizes an external pressure source to return the pedals to the forward position. Support Springs 40 would still support the Track Bars 12 and 13, but the pressurized air to return the pedals would not be supplied by cylinders actuated by the track bars. Instead, Air Input Tubing 48 supplies pressurized air or other fluid to a Right Limit Valve 46 and a Left Limit Valve 47 (Looking from the front of the machine, "right" is on the left in FIG. 7 and "left" is on the right.) The Limit Valves 46 and 47 are positioned as shown to be actuated by downward motion of corresponding Track Bars 12 and 13 so that pushing down the Right Pedal 16 actuates Right Limit Valve 46 which, in this actuated position, switches the normally closed valve to open to the Right to Left Tubing 44 to provide air pressure to Left Return Cylinder 43 which returns Left Pedal 17 forward. The Left Pedal 17 in FIG. 7 is up, releasing the Left Limit Valve 47 which, in the unactuated state as shown blocks the pressure input and switches the Left to Right Tubing 45 to "exhaust", allowing the Right Return Cylinder 42 to retract and the Right Pedal 16 to be pushed rearward. Adjustable flow resistance can be provided at the exhaust ports of the Limit Valves 46 and 47 to provide adjustable rearward push resistance at each Pedal.

In this externally powered machine (Pedal return is powered.), very little vertical movement of each pedal would be needed to return the opposite pedal. Of course, switching means which sense force or pressure with practically zero motion could be employed, but some motion is desirable for cushioning. Also, a fully powered machine could be provided, for example, by making the Return Cylinders 42 and 43 two-way actuating to power the pedals backward when pushed down and forward when the opposite pedal is down.

Figure 9:
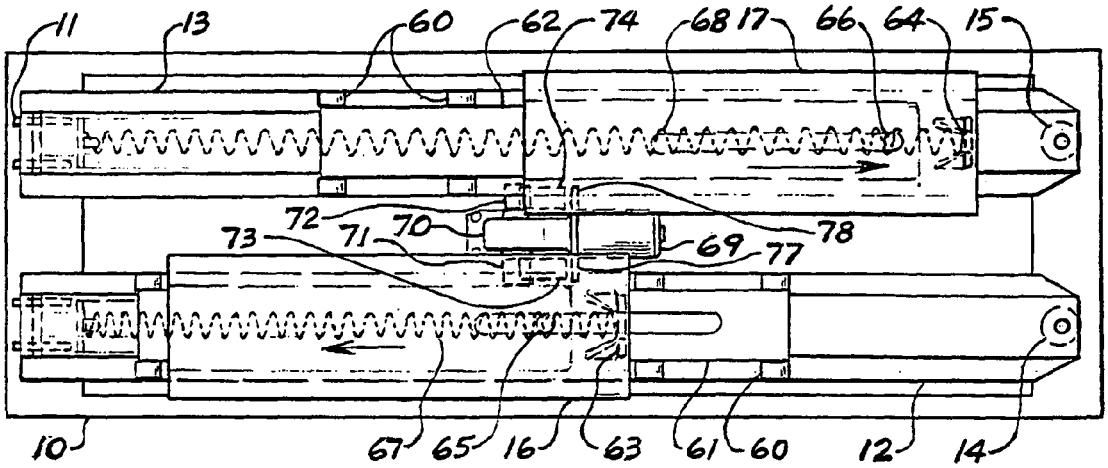
FIG. 9 is a plan view of a motor powered version of the invention.
Figure 10:
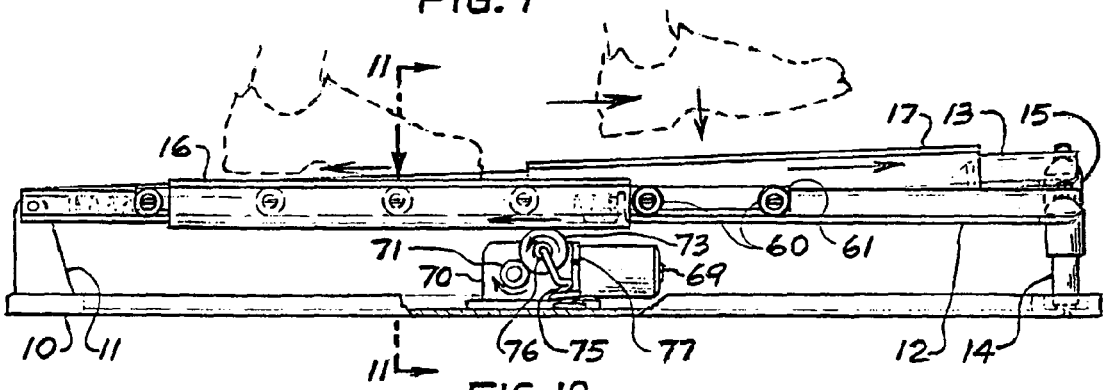
FIG. 10 is a side elevation view of the FIG. 9 machine.

FIGS. 9 and 10 are plan and side elevation views respectively of a powered version of the invention wherein an electric motor drives and regulates the speed of pedal travel rearward when the pedal is weighted and down. In this version pedal return is not dependent on downward force and motion of the opposite pedal, but returns under spring force when released by the user's foot force and the driving force of the motor drive. Many of the parts in this machine are basically the same in form and function as in the FIG. 1 version including a Base 10, Track Bar Pivot Tabs 11, Track Bars 12 and 13, Spring Dampers 14 and 15 and a Right Pedal 16 and Left Pedal 17. Instead of wheels attached to the pedals, light weight tubular Rollers 60 (preferably of plastic material) are spaced and held in place by a Right Roller Spacer 61 and a Left Roller Spacer 62 (also preferably of light weight plastic), each having an inverted "U" shape to span both sides of its corresponding Track Bar 12 and 13 and having tab projections extending into the hollow centers of the Rollers 60. Thus, each pedal will roll along its corresponding track bar resting on the Rollers 60 while the rollers roll along the two flanges of the track bar as in a roller bearing, the rollers and the spacers moving half as far as the pedals. This design allows the pedal and the total assembly to be lighter, with more evenly distributed loading and no heavy wheel bearings and attaching points on the pedals. A Right Return Lug 65 on the underside of Pedal 16 and a Left Return Lug 66 on Pedal 17 engage corresponding slots in the top of Right Roller Spacer 61 and Left Roller Spacer 62 respectively to insure the return of the roller assemblies forward on each return stroke when little downward force will exist on the rollers.

Figure 11:
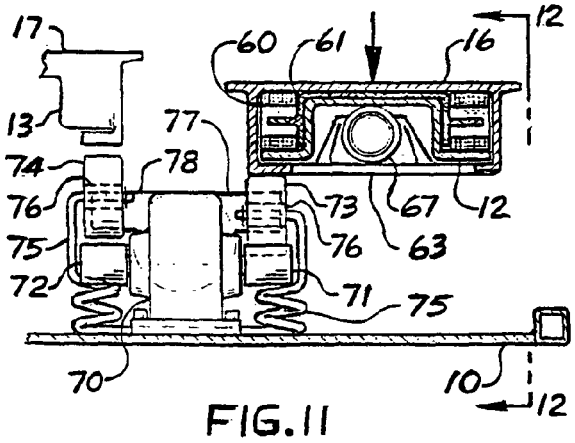
FIG. 11 is a partial sectional elevation view from FIG. 10 showing an end view of a pedal and the drive assembly.

The Pedals 16 and 17 in this machine are held forward by long, relatively low force compression springs under the Track Bars 12 and 13, a Right Return Spring 67 pushing against a Right Spring Lug 63, an integral part of Right Pedal 16 on a lower cross-bar part of the pedal as shown in FIG. 11, the pedal thus surrounding the track bar at this point. Likewise, a Left Return Spring 68 pushes Left Pedal 17 forward through a Left Spring Lug 64. The Return Springs 67 and 68 are fixed to a part of their respective Track Bars 12 and 13 at their rearmost ends under the track bars, and can be designed to have an unloaded free length to match the desired forward position of the pedals. Spring stops similar to the Stop Springs 19 of FIG. 1 can be used to stop the forward travel of the pedals also.

Thus, the Pedals 16 and 17 are movable in long paths back and forth and short up and down strokes as in the previous versions and stepping on a pedal causes it to descend and releasing it allows it to rise. Pushing back on either pedal causes it to move rearwardly and releasing it in this spring return version causes it to move forward. In this version, to provide a steady "regulated" pedal speed when a user walks or runs on them, a Motor 69 and a closely coupled Gearbox 70 are positioned under the Track Bars 12 and 13 with a Right Drive Drum 71 and Left Drive Drum 72 fixed on output shafts on either side of the Gearbox 70 as seen in FIG. 11. Two "floating" wheels, a Right Drive Wheel 73 and a Left Drive Wheel 74 (preferably made of a plastic-rubber type material but with a harder pre-lubed center hub or bearing) are mounted in line with their respective Drive Drums 71 and 72 to freely rotate on either end of a Drive Wheel Spring 75 so that they either lightly contact or almost contact their respective drive drums when the pedals are up and unweighted. As shown in FIG. 11 the inside bottom edge of each pedal is made stronger and wider to form a continuous lengthwise downward facing driving surface along the bottom edge aligned with the respective Drive Wheel (73 for Right Pedal 16) under it. When a pedal is up (Left Pedal 17 in FIG. 11) a clearance is maintained between the pedal and its Drive Wheel 74 while, when a pedal descends with the user's weight on it (Right Pedal 16), the bottom edge of the pedal is pushed down against its Drive Wheel (73). Due to a rearward inclination of the Drive Wheel Spring 75 toward the Drive Drum 71 as seen in FIG. 10, the downward pedal force also causes a rearward component of the upward spring force to force the Drive Wheel 73 against Drive Drum 71.

When the Motor 69 is running, rotation of the Drive Drum 71 is clockwise as shown, driving the Drive Wheel 73 counter-clockwise and driving the Pedal 16 rearward as indicated. The inclined Drive Wheel Spring 75 maintains a driving force between Pedal 16 and the Drive Wheel 73 and between the Drive Wheel 73 and the Drive Drum 71 throughout the rearward travel of the pedal while the user's weight holds the pedal down. The floating, or spring-loaded Drive Wheel 73 insures maintaining the driving contact over a range of user weights and resulting pedal down stroke levels. The Left Pedal 17 operates in the same way in conjunction with its Drive Wheel 74 and Drive Drum 72. For simplicity, the Drive Wheel Spring 75 is a double spring as seen in FIG. 11 having a bottom or base wire section joining the two upwardly inclined coils and drive wheel supporting axes at the top ends, the base wire section passing under the base of the Gearbox 70 through a groove in same as shown to hold the Drive Wheel Spring 75 in place.

As shown in FIG. 10, as the user steps on the Right Pedal 16, the pedal descends and moves rearward, driven by the Motor through the drive train described. At the same time, the user swings his left foot forward, as in normal walking, toward the Left Pedal 17 which is up and forward at the step-down position. When his right foot has reached his desired length of stride to the rear, the user simply steps down, as in normal walking or running, with the left foot on the Left Pedal 17. This causes an immediate unweighting of the opposite or right foot which will lift off of Right Pedal 16 and start to swing forward, and releasing the Pedal 16 from both the foot and Drive Wheel 73 causing Pedal 16 to be propelled quickly forward by Right Return Spring 67. As the Left Pedal 17 descends under the user's weight at step-down, the Left Pedal 17 with the left foot starts moving rearward, now driven by the Motor 69 through Left Drive Wheel 74, repeating the cycle as described for the right foot. Thus, it can be seen that the user is free to walk or run in a normal manner and to change his stride length from one stride to the next, simply stepping down sooner or later in any stride.

Figure 12:
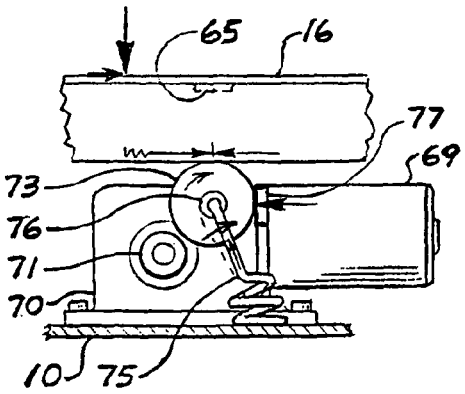
FIG. 12 his a larger scale partial side elevation view from FIG. 10 showing the drive assembly and the brake action.

In FIG. 12 an additional advantage of the combination of separately moving pedals and floating drive wheels is shown. The Right Drive Wheel 73, in its center hub or bore has a Sprag Clutch 76 which allows the drive wheel to rotate freely counter-clockwise as previously described when the user is walking normally with some small rearward foot force. With the Sprag Clutch 76, if the user wants to stop and pushes forward on the Pedal 16, resisting rearward motion, the Drive Wheel 73 will start to be driven forward at the top with the Pedal 16 or clockwise, causing the Sprag Clutch 76 to grip its axle which is the top horizontal leg of the Drive Wheel Spring 75, applying a clockwise moment to the Spring 75 and pulling the Drive Wheel 73 away from and out of contact with the Drive Drum 71 as indicated. A Right Stop Bar 77 is fixed to the Motor 69 and Gearbox 70 and extending closely in front of the Drive Wheel 73 as shown in FIG. 10. When the user pushes forward on the Pedal 16 as just described, the Drive Wheel 73 contacts the Stop Bar 77 as shown in FIG. 12 and the Drive Wheel 73, with the Pedal 16 pushing down against the substantial spring force, will stop, holding the pedal at the point at which the user started to push forward on the Pedal 16. This allows the user to stop at any point in a stride by leaning back and pushing forward on the pedal, both sides working the same, with a similar Left Stop Bar 78 for Left Pedal 17, and to restart by simply pushing rearward again. The most likely point at which to stop would be at the stepdown position, since the normal reaction in stopping is to immediately step down on the unweighted foot moving forward, so it is easy to push forward with the foot at step-down without any "leaning", the natural action in stopping being to step farther out forward just before the foot touches down and pushing forward with the foot at step-down. Another advantage of this brake or stop is its ability to continuously hold the pedal from freely moving forward when a user steps on the pedal, avoiding any accidental or unintended motion.

Figure 13:
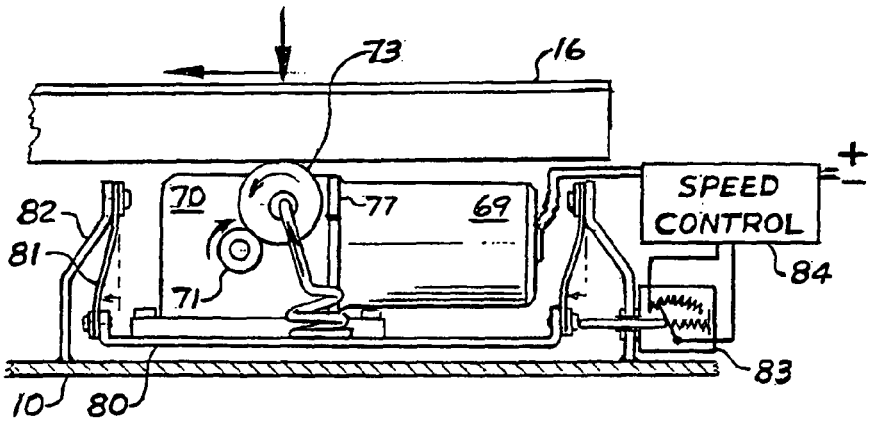
FIG. 13 is another partial side elevation from FIG. 10 showing an alternate motor drive assembly with speed control.

An additional feature can be added to a motor driven machine, automatic speed control as shown in FIG. 13. Here, one embodiment is shown wherein the complete motor-drive assembly including the Motor 69, Gearbox 70, Drive Drums 71 and 72, Drive Wheels 73 and 74, Drive Wheel Spring 75, Sprag Clutches 76 and Stop Bars 77 and 78, is mounted on a Floating Drive Base 80. This Base 80 is mounted on leaf-spring-like Flexures 81 attached at either end of the Base 80 and suspending it from fixed Flexure Supports 82 so that the Base 80 and the entire drive assembly is movable back and forth in the direction of pedal travel while spring-biased toward a neutral unloaded centered position. A Position Sensor 83 is fixed on the Base 10 at the front end of the Floating Base 80 and is positioned to detect any forward and backward movement of the Base 80 as shown. The Position Sensor 83 is represented in FIG. 13 as a simple variable resistor which is actuated by movement of the Floating Base 80 so that as the Base 80 moves rearward (left in FIG. 13) the resistance decreases, and if it moves forward, resistance will increase. Typically sensors are small and operate on low power circuits, therefore a Speed Control 84 is shown electrically connected to Position Sensor 83 which will amplify the low power varying output of the Sensor 83 to provide proportionately varying output power or signal to vary the speed of the Motor 69 in proportion to deflection of the Floating Base 80. The Speed Control 84 would include adjusting means to adjust or vary the normal or base speed and/or load and sensitivity or gain. Thus, when the Pedal 16 is down with the Drive Wheel 73 engaged, contacting both Pedal 16 and Drive Drum 71 as shown in FIG. 13, a rearward force (left in FIG. 13) on the Pedal will apply a rearward force on the Drive Wheel 73 and thus on the entire drive assembly and Floating base 80 and cause a proportionate rearward deflection of the Base 80 on the Flexures 81 as shown. This deflection will, at the same time, cause the Position Sensor 83 to send a decreasing resistance or higher current signal to the Speed Control 84 which, in turn, will increase the speed of Motor 69.

To increase speed, the user simply pushes rearward with more force than normal and to decrease speed, he can simply push less than normal or let the pedal push his foot. The "normal" or neutral force at which no speed change occurs, as described above, could be adjustable in the Speed Control 84 either directly or remotely. The user would only have to push harder for a short time to speed up, then the speed would stay at the new higher speed until another higher than normal force is detected to speed up more, or until a less than normal force is detected which will slow the pedals down as long as the reduced force continues. Since both pedals are driven as previously described by the same Motor 69 and drive assembly on the Floating Base 80, forward and rearward forces on both Pedals 16 and 17 will control the speed. If a higher level of forward force is exerted the Stop Bars 77 and 78 will still act as described earlier to stop the pedals and, at the same time, reduce the speed of the Motor 69.

There are numerous types of displacement, motion and force sensors that could be employed in this control scheme as outlined, and these can be applied at any of numerous points in the "force chain" from the pedal to the motor. Since friction drag of light pedals on rollers as in the present design is much lower compared to the typical sliding belt treadmill, power requirements will be significantly less and foot force rearward or forward will be a larger part of the total motor load. Thus, not only would drive force reaction sensing as described above be much more effective and responsive in this pedal type machine, an electrical line power sensor on the input wiring to the motor could also be a practical alternative speed control input. Obviously, a forward-rearward force sensor in or on the pedal would also be a possibility, but would be more complex due to the moving pedal having to be connected to the control circuit.

Figure 14:
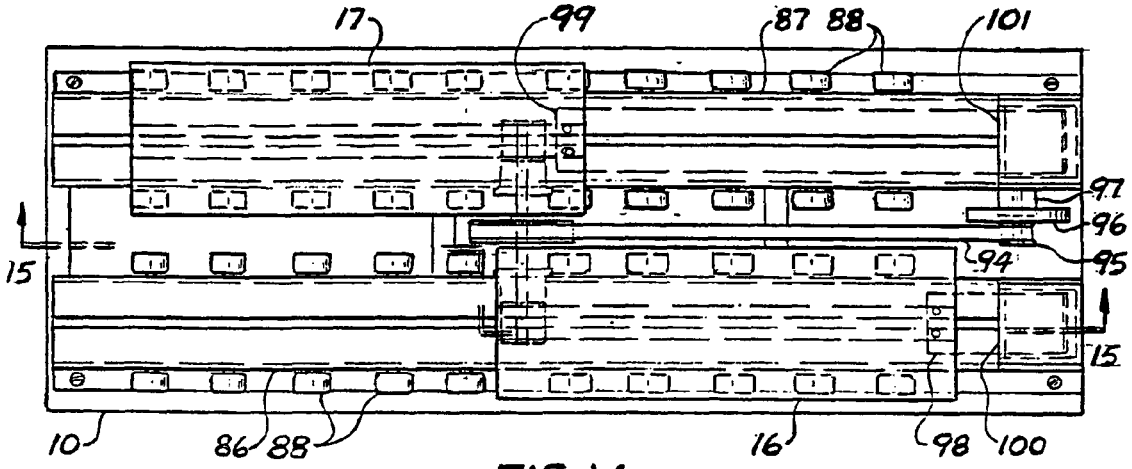
FIG. 14 is a plan view of a flywheel speed regulation version of the invention.
Figure 15:
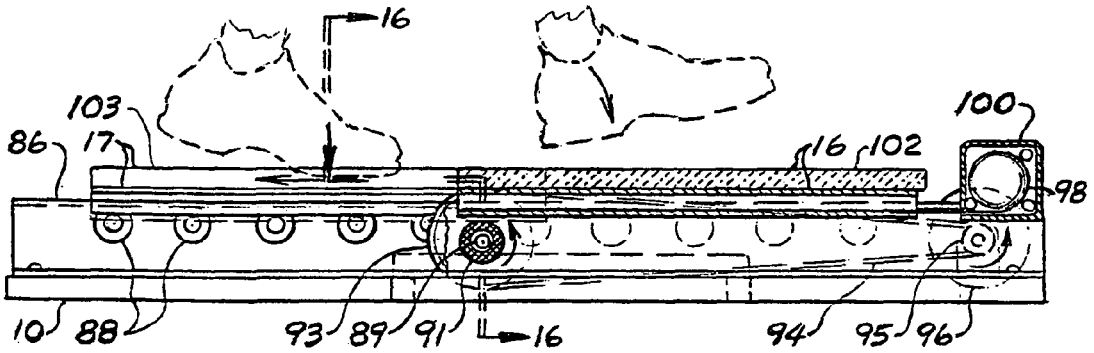
FIG. 15 is a side elevation view of the FIG. 14 machine.

FIGS. 14 and 15 are plan and side elevation views respectively of a user powered version of the invention employing a flywheel and rotational resistance to regulate the speed of pedal travel rearward and spring means to return the pedal forward. In this version the pedals exhibit no vertical displacement except for flexing of the pedal itself, and provide step-down cushioning mainly with cushion means on the pedals. Again, some parts are basically the same as in above described versions including a Base 10, a Right Pedal 16 and a Left Pedal 17. There are no pivoting track bars or spring dampers but, instead, fixed longitudinal pedal guides, a Right Guide 86 and a Left Guide 87, each having a series of Support Wheels 88 fixed and spaced along either side of each Guide to support the pedals, Pedal 16 to roll along Right Guide 86 and Pedal 17 to roll along Left Guide 87. The Guides 86 and 87 each have a central slot running the length of each guide.

Figure 16:
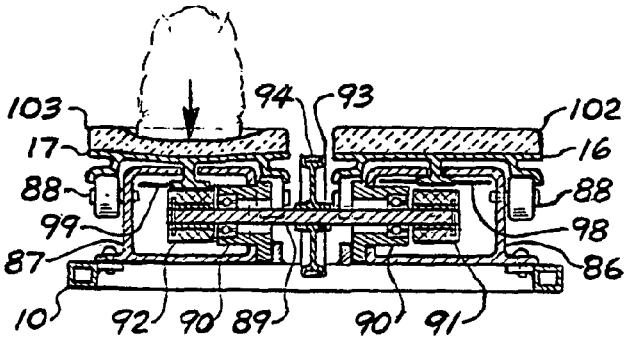
FIG. 16 is an end sectional elevation view from FIG. 15 showing pedals and drive parts.

As seen in FIG. 16, an end sectional elevational view from FIG. 15, each Pedal has a central longitudinal inverted "T" rib extending down from the bottom surface which is an integral part of each pedal (preferably a reinforced plastic molded part), the "T" rib extending down through the central slot in the respective guide. The cross bar of the "T", thus, is below the top of the guide running longitudinally in a hollow space in the guide while the body of the pedal is guided by its central rib in the slot of the guide. A Shaft 89 aligned transversely to the machine is positioned under the Pedals 16 and 17 and below the top surfaces of the Guides 86 and 87 and supported rotatably on two Support Bearings 90 mounted on the guides and Base 10. A Right Drive Wheel 91 is fixed to the right end of the Shaft 89 and a Left Drive Wheel 92 on the left end, each drive wheel aligned with its respective pedal's center inverted "T" rib and spaced close to the lower surface of the rib, but not contacting the pedal when the pedal is unweighted as shown for the Right Pedal 16 in FIG. 16. When the pedal is weighted as is the Left Pedal 17 in FIG. 16, the pedal flexes downward at its center so that the center rib is forced down against its respective Drive Wheel 92 as shown.

The Drive Wheels 91 and 92 would be made of a rubber-plastic type material for flexibility and gripping capability. A Drive Pulley 93 is fixed on the Shaft 89 at the center of the machine between the two pedal/guide assemblies to rotate with the shaft. A Drive Belt 94 runs on Drive Pulley and forward to and around a second Drive Pulley 95 which in turn is fixed to a Flywheel/Resistor 96, both rotatably mounted as a unit on a Support Spindle 97 at the front of the machine. The Flywheel/Resistor 96 would comprise friction, magnetic or other resistance means that would be adjustable as is typical in exercise cycles and the like. Thus, rotation of the Shaft 89 and Drive Wheels 91 and 92 will cause simultaneous rotation of the Flywheel/Resistor 96, and when either Pedal 16 or Pedal 17 is weighted, the pedal's longitudinal motion will translate to rotary motion of the Flywheel/Resistor 96 as indicated in FIG. 14. To return the pedals forward a Right Band Spring 98 and a Left Band Spring which are extending/retracting band type tension springs as shown in FIGS. 14, 15 and 16 are attached at their extending ends to the front ends of their respective Pedals 16 and 17. The forward ends of the band springs are attached to and extend from and retract into respective enclosures, a Right Spring Housing 100 and a Left Spring Housing 101, both fixed to the front ends of their respective guides 86 and 87. Thus, as a pedal is weighted as is Pedal 17 in FIG. 16 and is pushed rearward by the user's foot, the pedal engages its respective Drive Wheel 92 (or 91 for Pedal 16) which causes the flywheel/resistor to rotate, providing stability and resistance to movement of the pedals while the forward tension of each pedal's attached band spring also provides some resistance.

When the user ends the pushback stride on his left foot, stepping down on the Right Pedal 16 with his right foot and lifting his left foot, the Left Pedal 17 will flex upward again to its normal unloaded form, releasing its contact with Left Drive Wheel 92, and the Left Band Spring 99 will pull the Pedal 17 forward to the step-down position. At the same time, the right foot starts pushing rearward on the Right Pedal 16, and it is now either driven by or driving the Flywheel/Resistor in the same manner as was the Left Pedal 17. Thus, the user walks or runs in normal varying length strides as in earlier described versions, and during each stride the motion of the pedals is controlled by the user's rearward foot force including rearward component of the user's weight due to inclination of the machine opposing the resistance of the Flywheel/Resistor 96 with adjustable resistance.

To provide cushioning of each step-down in addition to the pedal flexing, a Right Pedal Cushion 102 and a Left Pedal Cushion 103 are attached by adhesive to the top surfaces of their respective Pedals 16 and 17. To provide double duty, these cushions are employed to dampen the stop of their respective pedals at the forward end of their return strokes by extending the cushion material beyond the front of each pedal as seen in FIG. 15, the Spring Housings 100 and 101 providing the fixed stop surfaces.

Another advantage over belt treadmills lies in the fact that a pedal type machine has only a relatively small surface, two pedals, to cushion compared to a full loop of belting when considering cushioning on top of the pedal or belt, and the continuous flexing of a belt around the end pulleys makes top of belt cushioning impractical and/or costly. The relatively small pedals allows simple, low cost replaceable cushions. Under-the-belt cushioning in treadmills is also costly and problematical and increases the already high belt drag. Further, the Pedal Cushions 102 and 103 can be air bag type cushions, possibly in combination with plastic foam or other cushion materials and, with adjustable air pressure, the cushion effect could be adjusted.

Figure 17:
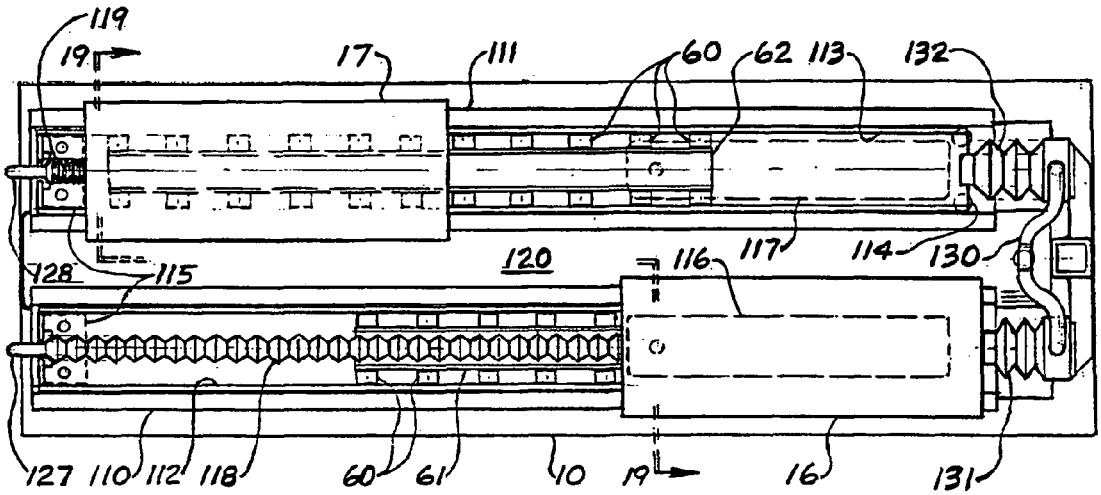
FIG. 17 is a plan view of a pneumatic machine for user powered or externally powered operation or a combination of both, and with energy conservation using a compressed air reservoir.
Figure 18:
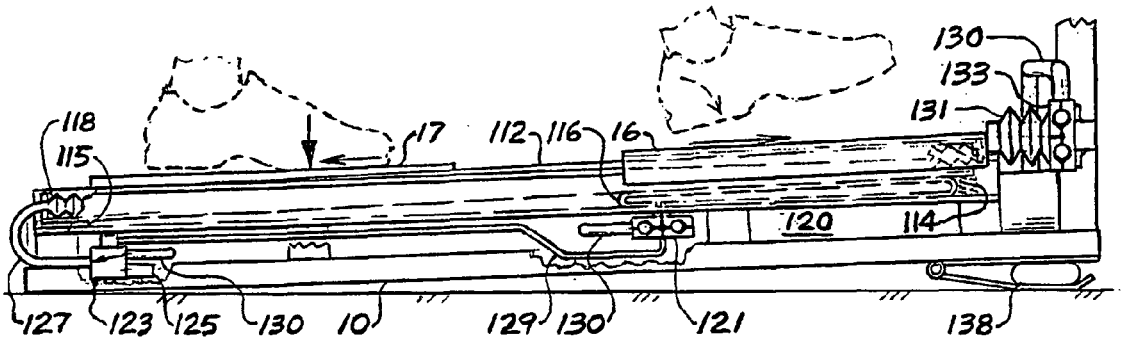
FIG. 18 is a side elevation view of the FIG. 17 machine.
Figure 19:
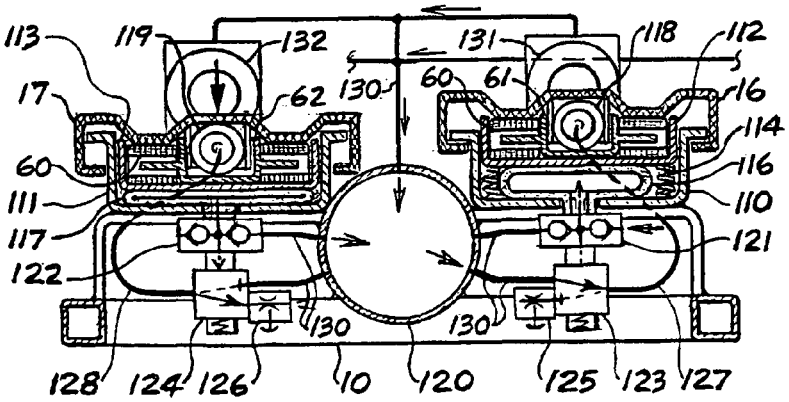
FIG. 19 is an end sectional elevation view from FIG. 16 showing pedals and the pneumatic system.

FIGS. 17 and 18 are plan and side elevation views respectively of a pneumatically cushioned pedal machine which accumulates air pressure energy from step-down on the pedals and from pedal return deceleration and optionally from arm/upper body exercise levers to indirectly provide pressurized air to return the pedals forward. This version has a reservoir or compressed Air Tank 120 into which air is pumped from several sources and valving means to direct pressurized air from the tank to return each pedal when the same pedal is unweighted. Using rear foot lift-off as a signal for pedal return instead of step-down of the opposite foot could have a slight advantage in getting the returning pedal up to the step-down position in time for fast running strides since, in running, lift-off of the rear pushing foot occurs slightly before front foot step-down. As in the above versions, a Base 10 is provided along with a Right Pedal 16 and a Left Pedal 17 mounted to reciprocate side by side back and forth in varying stroke lengths. A Right Pedal Guide 110 and a Left Pedal Guide 111 are fixed to the Base 10 or extensions thereof and aligned longitudinally side by side to guide the respective Pedals 16 and 17 as seen in FIG. 19, an end sectional elevation view from FIG. 17. This design, with fixed Pedal Guides 110 and 111, reduces deflected mass at step-down by employing relatively light "floating tracks", a Right Track 112 and a Left Track 113 which are relatively loosely held and guided within their respective "U" shaped Guides 110 and 111 with freedom to move up and down at their forward ends. These Tracks 112 and 113 are supported at their forward ends by Support Springs 114 and mounted on flexible (rubber type material) Track Pivot Pads 115 at their rearmost ends so they can be pushed down at their forward ends and will spring back up when released. The Pivot Pads 115 may be held to the floor of their respective Guides 110 and 111 and to the Tracks 112 and 113 by molded-in lugs or tabs that match holes in the Guides and Tracks and may be bonded with adhesive, the intent being to have a soft, impact-absorbing hinge for the very small angular motion of the Tracks 112 and 113.

A series of Rollers 60, spaced in two rows under each Pedal 16 and 17 are held in place by a Right Roller Spacer 61 and a Left Roller Spacer 62 with tab-like projections extending into hollow centers of the Rollers 60. Thus, each Pedal 16 and 17 rolls back and forth along its respective Track 112 and 113 on the Rollers 60 and guided laterally by the fixed Pedal Guides 110 and 111 as seen in FIG. 19. In addition to the Support Springs 114 under the front ends of Tracks 112 and 113, relatively long Air Bags 116 and 117 are positioned under the Tracks on the floor of the respective "U" shaped Guides 110 and 111, a Right Air Bag 116 under Track 112 and Pedal 16, and a Left Air Bag 117 under Track 113 and Pedal 17. These Air Bags are preferably made of a plastic-rubber type material and extend in length about as long as the pedal length as shown to provide the required supporting force at relatively low air pressure in the air bag and to distribute the force along the respective Tracks 112 and 113 so these can be made as light as possible. Each Air Bag 116 and 117 has an integral port nipple on its bottom side for air infeed and exhaust, these nipples extending down through holes in the bottom of their respective Guides 110 and 111. Thus, when the Right Pedal 16 is stepped on, it and its supporting Rollers 60 and Roller Spacer 61 and Right Track 112 descend as a unit, compressing the Support Springs 114 and Right Air Bag 116. When the Pedal 16 is unweighted these parts all rise, the Springs 114 designed to provide an upward force to lift and support the total moving assembly and open the Air Bag 116 as shown on the right side in FIG. 19. The Air Bags 116 and 117 may be made of a rubber-type elastic material of sufficient wall thickness and stiffness which, combined with a molded shape, will cause them to spring back to an expanded shape as on the right in FIG. 19 when the pedal is released and rises. Thus, air is expelled from either air bag when the respective pedal is pushed down as is the Left Pedal 17 in FIG. 19 and is pulled back in as the pedal is unweighted and rises as for Right Pedal 16 in FIG. 19. Adhesive or other means may be used to, hold the bottom surface of each air bag to its guide and to hold its top surface to the bottom of its respective track if required to insure air bag reinflation on each pedal upstroke.

For forward return of the pedals as well as resistance during rearward pedal strokes, a Right Bellows 118 is attached at its forward end to Right Pedal 16 to an integral lug under the pedal and a Left Bellows 119 is similarly connected to Left Pedal 17, each extending longitudinally under the respective pedals and lying in the respective "U" shaped Tracks 112 and 113 and in the "U" shape of the respective Roller Spacers 61 and 62 and fixed at their rearmost ends as seen in FIG. 17 to end walls of the respective tracks. The front ends of the Bellows 118 and 119 are closed at their connections to the respective pedals, while the rear fixed ends each have an infeed/exhaust port, so that applying pressurized air at the port will extend the bellows longitudinally and propel the respective pedal forward and pushing the pedal back will compress the bellows and force air out the port.

A centrally positioned Air Tank 120 extending the length of the machine between and below the Pedals is shown as an integral part of the frame or Base 10. Thus, its tubular shape (preferably of thin wall steel or aluminum) can add strength and stiffness to the frame and have adequate volume capacity, while being close to the various pumping elements and air consuming elements of the machine for minimal flow losses. A Right One-Way Valve 121 comprising two check valves as shown diagrammatically in FIG. 19 is connected pneumatically at a central port between the check valves to the port of Right Air Bag 116. An outlet port of the Valve 121 is connected to an inlet to the Air Tank 120 through a length of Tubing 130 and an inlet port of the Valve 121 is open to atmosphere. Thus, when the Right Pedal 16 is weighted and descends, Right Air Bag 116 is compressed below Right Track 112 compressing air in the air bag and forcing air through the outlet port of Valve 121 to the Air Tank 120. Unweighting the Pedal 16 causes the Air Bag to expand and reduce pressure in it below atmospheric pressure drawing air through the inlet port of Valve 121 into the Air Bag 116. The Left Pedal 17 and Track 113 operate similarly on a Left Air Bag 117 through a Left One-Way Valve 122 to compress air into the Air Tank 120, FIG. 19 showing Left Pedal 17 down at the end of its stroke, completing its step-down and compression stroke. The port of the Air Bag 116 is also connected, through the One-Way Valve 121 as in FIG. 19, to the pilot or signal input port of a Right Pilot Valve 123 which is a three-way valve shown in one of two states: No pilot pressure or signal (Air Bag 116 unpressurized), connecting its pressurized port connected to the Air Tank 120 through Tubing 130 to its outlet port which is connected to the rear infeed port of Right Return Bellows 118 through Right Return Tube 127. Thus, with Right Pedal 16 released and Right Air Bag 116 not pressurized as in FIG. 19, the Right Pilot Valve 123 will direct pressurized air from the Air Tank 120 through flexible Right Return Tube 127 to Right Bellows 118 to extend it and return the Right Pedal 16 forward.

The Left Pedal 17 in FIG. 19 and its corresponding air circuit shows the opposite state, the Air Bag 117 being compressed with the pedal weighted and the pressure developed in the air bag sending a positive pressure signal to Left Pilot Valve 124 which is shifted to close the port pressurized by Air Tank 120 and open the Left Bellows 119 through Left Return Tube 128 to atmosphere through an exhaust port and through a Left Flow Control 126. Thus, when Pedal 17 is weighted as shown, causing a pressure rise in Air Bag 117 and a corresponding positive pilot pressure input to Left Pilot Valve 124, the pilot valve will close off air pressure from Air Tank 120 and open the rear port of Left Bellows 119 to atmosphere through the adjustable Flow Control 126 allowing Pedal 17 to be pushed back. Instead of the direct connection of the pilot valves at their pilot ports with their respective air bags through the one-way valves (a through port) as shown in FIG. 19, the ports are shown in FIG. 18 connected at a distance through a Pilot Tube 129 (one for each side) to position the Pilot Valves 123 and 124 to the rear of the machine to minimize flow losses through tubing to the Bellows 118 and 119. Pressure levels would be relatively low, likely in the five (5) pounds per square inch gauge (PSIG) range, so most of the valves and tubing could be made of light, thin wall plastic or the like.

In order to make a machine suitable for fast running where the Pedals would be required to return forward in a fraction of a second, the power and energy required to do this may be higher than that produced by step-down force on the pedal, unless the energy of deceleration of the pedal at the end of the return stroke is recuperated. This recuperation can be accomplished with this Air Tank version using Stop Bellows 131 and 132. As shown in FIGS. 17-19, a Right Stop Bellows 131 is fixed on the frame or Base 10 at the front end of stroke of and aligned with Right Pedal 16 so that the returning pedal is intercepted by the free end of Stop Bellows 131. The fast returning Pedal 16 as shown at its forward end of stroke in FIG. 17 is decelerated by the Bellows 131, compressing air in the bellows as it is compressed axially by the pedal. The Stop Bellows 131 is integrally connected with a Right Stop Valve 133 which is a one-way valve comprising two check valves as shown which acts in the same way as the One-Way Valves 121 and 122 under the Air Bags 116 and 117 as described, pumping compressed air to the Air Tank 120 through Flexible Tubing 130. The bellows would preferably be made of an elastic rubber-plastic such that upon movement of the pedal rearward away from the stop, it will spring back to its original uncompressed length, drawing in air through the lower inlet port of the Stop Valve 133. The Left Pedal 17 has an identical Left Stop Bellows 132 shown extended, and a Left Stop Valve 134 which operate in the same way, compressing air into the Air Tank 120 on each arresting of the pedal at the end of its forward return stroke. Thus, instead of wasting the energy of the pedals' forward velocity, a significant part of this energy will be recuperated and available for each following return stroke.

Figure 20:
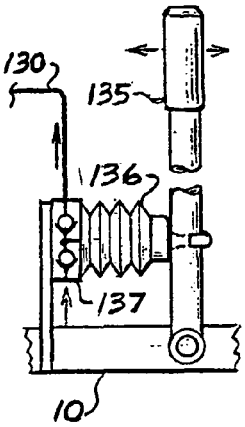
FIG. 20 is a side elevation view of an optional side mounted arm exerciser lever with air pumping means to compress air to the reservoir of the FIGS. 17-19 machine.

FIG. 20 shows an Arm Lever 135 which, as an option, may be mounted to pivot on the side of the Base 10 with an attached Arm Bellows 136 and integral Arm Bellows Valve 137 connected to the Air Tank 120 by Tubing 130 in the same way as the Stop Bellows 131 and 132. Moving the Arm Lever 135 back and forth, therefore, will pump air to the Air Tank 120, recuperating this arm exercise energy also. A pair of these arm lever pumps would be installed, one on either side of the machine where the user may pull back and forth to exercise the upper body while walking or running on the machine. Dual oppositely acting bellows pumps could be employed on each lever to provide resistance on both forward and rearward arm strokes.

Other sources of air pressure input to the Tank 120 may be employed such as a small motorized compressor or blower (5 to 10 PSIG) for initial startup and other purposes as explained further below. Simply a few stepping strokes on the pedals or similar strokes on the arm levers could pump the pressure in the Tank 120 up to operating level to start up. The Air Tank 120 could also include typically installed pressure gauge and a Relief Valve 139 as shown in FIG. 22.

Figure 22:
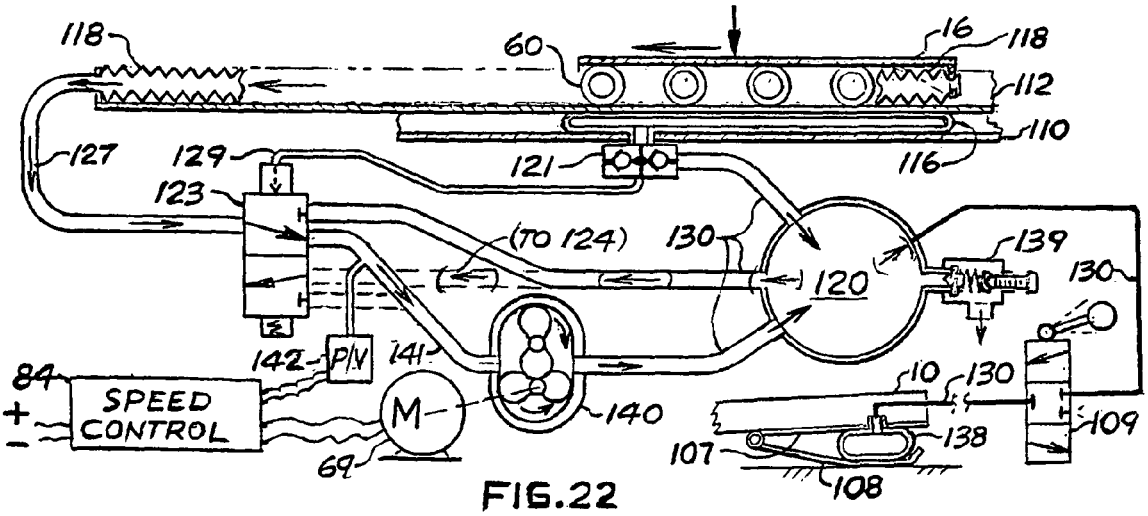
FIG. 22 is a diagrammatic side elevation view of a motorized version of the FIGS. 17-19 machine with automatic speed control.

FIG. 22 is a diagrammatic side elevation view of a further variation of the machine of FIGS. 17-21 employing a motorized positive displacement blower or Pump 140 powered by an electric Motor 69 to both pressurize the Air Tank 120 for pedal return as above described and power and regulate pedal rearward speed by valving each Pedal Return Bellows 118 and 119 alternately to the intake port of the Pump 140. FIG. 22 shows essentially the same right side pneumatic circuit as in FIGS. 18 and 19, but with the addition of a Relief Valve 139, a positive displacement blower or Pump 140 powered by a Motor 69, a Pump Inlet Tube 141, a Pressure Sensor 142 and a Speed Control 84. The Pump 140 and its Intake Tube 142 in effect replace the Right Flow Control 125 and Left Flow Control 126 at the exhaust ports of Pilot Valves 123 and 124 (left Pilot Valve 124 not shown in this view) and, instead of regulating rearward pedal speed by simple flow resistance vs. the user's foot force, the Pump 140 regulates the speed by controlling air flow with variable pump speed provided by Motor 69 and Speed Control 84. Pedal 16 must be weighted just as in FIGS. 17-19 where the Pilot Valve 123 switches Right Return Bellows 118 to "exhaust", allowing Pedal 16 to move rearward. In the FIG. 22 version it switches to the Pump Inlet Tube 141 and the Pump 140 will draw air out of the Return Bellows 118 at a steady rate, powering the Pedal 16 rearward. A Pressure Sensor 142, detecting pressure in the Bellows 118 and the Pump Inlet Tube 141 to which it is connected through Return Tube 127 and the Right Pilot Valve 123, effectively senses the user's rearward or forward foot force on the Pedal 16 as it moves along. The Left Pedal 17 when it is weighted will act in the same way, its Left Pilot Valve 124 also having its exhaust port connected to the Pump Inlet Tube 141 (Pilot Valve 124 would be directly behind Pilot Valve 123 in FIG. 22 and Pump Inlet Tube connected to both exhaust ports through a "Y" split of the Tube 141), and only the pedal that is weighted is thus powered and having its rearward force sensed while the unweighted pedal is switched oppositely and out of the exhaust loop.

It is important to note that, in a user powered machine, with only the user's foot pushing rearward, for the user to stay in place and not move forward (with no hip-level bumper or the like), the pedal's path of travel must be inclined up to the front, the user's weight component in the travel direction rearward balancing the travel resistance including roller resistance. A big advantage of pedals on rollers compared to a sliding belt treadmill is the much lower travel direction friction and thus, a significantly tower weight component and correspondingly lower incline required to walk or run on a user powered machine. This explains why very few user powered treadmills are in use. In the user powered pedal machines described herein, the additional resistance above the rolling resistance of the pedal rollers or wheels that is required to "regulate" the speed and provide a steadying resistance to the pedals' motion will be relatively low, and the incline required will be significantly lower than in a user powered treadmill, making a user powered pedal machine more acceptable (if such a machine existed for true normal walk-run action), with less "uphill climbing" involved. A powered or motorized machine overcomes the travel resistance by driving the pedal (or belt) rearward for the user, so no incline is necessary, though any incline will still reduce the power required from the motor drive.

A historical note in this regard, the first "treadmills" were developed as a source of rotary power employing a human or an animal such as a dog or horse to drive various machines such as a butter churn before electricity was available. Since these machines had to be tough and efficient, the "belt" was typically a series of wood slats on continuous chains and rollers for support. A motorized "slats over rollers" exerciser treadmill is available and used in some commercial gyms today, but costs more than most slider belt machines.

In this pedal machine, as in FIG. 22, a relatively low rearward force will be required to drive the pedals and the negative pressure or vacuum required of the Pump 140 will be correspondingly low, depending on the diameter and cross section area of the Return Bellows 118 and 119. At times, the pressure could be positive, if the user inclines the machine above the friction drag angle and when the user wants to speed up by pushing harder (in a user powered machine). The Pressure Sensor 142 therefore, would be selected to sense pressures in a range from about minus five (−5) to plus five (+5) PSIG, and would transmit an electrical signal to the Speed Control 84 that is proportional to the pressure level sensed at any time. The Speed Control 84 would receive a low power signal from the Sensor 142 as described earlier for FIG. 13 and increase the speed of Motor 69 if an increased pressure is sensed, indicating increased user foot force and desire for increased speed and conversely, decrease speed if a lower than "base" level pressure and foot force is detected. If there is no significant increase or decrease from the base level, the speed will remain constant and thus, only a short duration of increased foot rearward or forward force would be required, during which the user would temporarily hold handrails or the like or use some "body english", giving a quick thrust at the end of a stride and rebalancing on the next step-down. The Speed Control 84 could also include programming to sense a more extreme level of pedal forward force and duration, indicating the user wants to stop, at which point it would completely stop the Motor 69 and Pump 140.

On the pressure side of the Pump 140 the Air Tank 120 acts as an accumulator, storing energy in the form of pressurized air until required for pedal return. Pedal step-down force energy is also stored as described earlier for the FIGS. 17-19 version. When the user ends the rearward stride on the Right Pedal 16 and steps with the left foot on Left Pedal 17 (not shown in FIG. 22), lift-off of the right foot from Pedal 16 will cause a pressure drop to atmospheric or less in the Pilot Tube 129 to Pilot Valve 123, switching this valve to its opposite state (lower block of the valve diagram in FIG. 22) which directs pressurized air from Air Tank 120 to the Right Return Bellows 118 and quickly returns the Pedal 16 with the instantly available accumulated volume of pressurized air and continuing input from Pump 140. Also, the pneumatic Pedal Stop Bellows 131 and 132 as in FIGS. 17-19 would still be a good feature to include for efficient and quiet deceleration of the pedals, and these would still provide input to the Air Tank 120.

Thus, this powered version would operate in the same way as the user powered version, but with easier, powered rearward motion of the pedals, and the potential for higher speed running with assurance of fast enough pedal return. In a user powered version, in this regard, adequate pedal return speeds or minimal return times will depend largely on minimizing pedal mass and other related moving masses as well as friction drag. An air or pneumatic machine presents the possibility of reducing both mass and friction in the pedal propelling system to an absolute minimum. Back to the powered version of FIG. 22, a Relief Valve 139 on the Air Tank 120 is adjustable to adjust the maximum tank pressure and will vent excess flow resulting from more sources pumping air into the tank than consuming it.

The excess air can be put to use in one way by adding an air motor powered fan to cool the user or, more simply, directing a tube from the relief valve vent directly at the user. A more practical use would be an air bag operated machine incline jack as shown in FIGS. 17 and 22. As shown in FIG. 22 an Air Bag Jack 138, an elongated air bag, extends across the bottom front of the machine between a bottom Surface Plate 107 also extending across the width of the machine fixed to the Base 10 and a lower movable Foot Plate 108 pivotally attached to the Base 10. A three position manual Jack Valve 109 connects the Air Bag Jack 138 pneumatically to the Air Tank 120 through Flexible Tubing 130 when the valve lever is pushed up to valve air into the air bag to raise the front of the machine, while an unactuated middle position of the valve lever blocks all air flow, holding a given height of lift, and a downward push on the lever switches the valve to exhaust, lowering the machine. Since the Air Bag Jack 138 would not be used very often and would more likely require full air tank pressure at any time, its air supply line would best be tapped directly into the Air Tank 120 as shown. A relatively long Air Bag 138 extending across the width of the machine and a few inches wide in the machine lengthwise direction would easily lift the machine and user weight combined on the front of the machine with less than five (5) PSIG pressure available from the Air Tank 120.

Obviously many variations of the invention are possible, especially the pneumatic. Pedal return could be initiated by lift-off from the same pedal or by step-down on the opposite, or by a combination of both with a bit more pneumatic logic. This would likely be superfluous since, even in the FIG. 1 mechanical version wherein front foot step-down actuates the opposite pedal's return, if a user places only a part of his weight on the front pedal and keeps a good part of his weight on the other foot on the rear, the leverage would prevent pedal return. This would be another way for the user to stop, or the user, with somewhat less force on the rear pedal, could let his foot return with the pedal. Powered return versions as in FIG. 7 (pg. 20) and FIG. 22 (pg. 34, ln. 19) could provide even more return force to assist a user's foot return if desired.

I claim as my invention:

1. A reciprocating foot pedal exerciser for realistic, normal walking, jogging, running and stepping in place enabling automatically variable length strides, comprising:

a pair of foot pedals for receiving user foot action at a substantially constant forward step-down position on the exerciser;

support means for guiding said foot pedals in primarily back and forth strokes variable rearwardly from said forward step-down position and means for returning said foot pedals to said forward step-down position at the end of each stride independently of stride length;

said means for returning applying a return force to a foot pedal only during each said foot pedal's return stroke.

2. The exerciser of claim 1 wherein said means for returning returns a rearmost one of said foot pedals to said forward step down position using step-down energy.

3. The exerciser of claim 1 having arresting means for stopping returning said foot pedals at said forward step-down position, energy conversion means and energy storage means for recuperating energy of returning said foot pedals and means for applying said energy to said means for returning.

4. The exerciser according to claim 1 further including power and control means for connecting the downward force and deflection of a forward one of said pedals to the rearward one of said pedals to propel said rearward pedal forward.

5. The exerciser in accordance with claim 1 wherein said means for returning includes fluid means.

6. The exerciser according to claim 1 further including a speed regulating means for controlling rearward motion of said foot pedals.

7. The exerciser according to claim 6 wherein said regulating means comprises spring and damper means.

8. The exerciser according to claim 6 wherein said regulating means comprises rotary resistance means.

9. The exerciser according to claim 1 further including a motorized speed regulating means for controlling rearward motion of said foot pedals.

10. The exerciser according to claim 9 wherein said regulating means comprises frictional drive means interconnecting said motorized means and said foot pedals.

11. The exerciser according to claim 9 wherein said regulating means comprises fluid pumping means interconnecting said motorized means and said foot pedals.

12. The exerciser according to claim 9 further comprising:

a sensor means for sensing the user's foot force rearward or forward on said foot pedal and;

a control means for receiving a signal from said sensor means and to vary the speed of said motorized means in response to said foot force.

13. The exerciser according to claim 1 further including foot pedal braking means to brake forward motion of said foot pedal when said user is standing on said foot pedal.

14. The exerciser according to claim 2 further including a means integral with said return means for cushioning the user's step-down on said foot pedal.

15. The exerciser of claim 1 wherein said means for returning employs energy sources external to a user.

16. The exerciser of claim 15 wherein said external energy sources include fluid power means.

17. The exerciser of claim 1 wherein said means for returning employs stored energy from a plurality of sources.

18. A reciprocating foot pedal exerciser for walking, jogging, running and stepping in place enabling automatically variable length strides, comprising:

foot pedals for receiving user foot action at a forward step-down position;

support means for guiding said foot pedals in primarily back and forth strokes variable rearward from said step-down position and means for returning said foot pedals to said forward step-down position at the end of each stride at velocities substantially greater than stride velocity;

said means for returning applying a return force to a foot pedal only during each said pedal's return stroke.

* * * * *